US005231844A

United States Patent [19]

Park

[11] Patent Number: 5,231,844

[45] Date of Patent: Aug. 3, 1993

[54] DEFROST CONTROL METHOD FOR REFRIGERATOR

[75] Inventor: Yon T. Park, Kyungki, Rep. of Korea

[73] Assignee: Samsung Electronics Co., Ltd., Suweon, Japan

[21] Appl. No.: 822,917

[22] Filed: Jan. 21, 1992

[30] Foreign Application Priority Data

Jan. 26, 1991 [KR] Rep. of Korea ..... 91-1325

[51] Int. Cl.[5] ..... F25D 21/06

[52] U.S. Cl. ..... 62/80; 62/153; 62/155; 62/156

[58] Field of Search ..... 62/153, 154, 155, 156, 62/234, 80, 81, 82

[56] References Cited

U.S. PATENT DOCUMENTS

| | | | |
|---|---|---|---|
| 2,064,396 | 12/1936 | Volpin | 62/153 |
| 2,297,370 | 9/1942 | Siedle | 62/153 X |
| 2,519,700 | 8/1950 | Radcliffe | 62/153 |
| 4,297,852 | 11/1981 | Brooks | 62/153 |
| 4,327,556 | 5/1982 | Zampini et al. | 62/155 |
| 4,528,821 | 7/1985 | Tershak et al. | 62/153 |
| 4,646,536 | 3/1987 | Yamada et al. | 62/234 |
| 4,938,027 | 7/1990 | Midlang | 62/153 X |

*Primary Examiner*—Harry B. Tanner

[57] ABSTRACT

A refrigerator is defrosted by comparing a sensed temperature in the refrigerator with a predetermined temperature when a defrost start time is reached. If the sensed temperature is too high, a compressor is caused to operate in order to reduce the temperature to the predetermined temperature. Then, the open/closed conditions of the refrigerator doors are sensed, and the defrost heater is activated if the doors are sensed as being closed.

5 Claims, 4 Drawing Sheets

DEFROST CONTROL METHOD FOR REFRIGERATOR

BACKGROUND OF THE INVENTION

The present invention relates to a defrost control method for a refrigerator, and particularly to a defrost control method which evaluates the defrost time, the temperature inside the refrigerator and the position of the doors and then initiates the defrost operation when the three conditions are satisfied.

A prior art defrost control method, as shown in FIG. 1, is a method which initiates the defrost operation if the operation period of the compressor reaches a predetermined time, irrespective of the temperature inside the refrigerator. A typical example of the method is disclosed in U.S. Pat. No. 4,528,821. However, the problem with this method is that the defrost operation is executed while the operation of the compressor is switched from the "on" state to the "off" state or during a period when the temperature within the refrigerator is at the upper end of its range at which stored foods deteriorate.

Accordingly, in order to avoid this problem, as shown in FIG. 2, the defrost operation is executed after the temperature in the refrigerator is reduced by causing the compressor to operate prior to the defrost operation or when, as disclosed in Japanese Utility Laid-Open Publication No. 64-22972, the temperature in the refrigerator and the defrost time are evaluated and the two conditions are satisfied. However, the problem with this method is that during the operation in low temperature, a refrigerator wastes power by causing the compressor to operate prior to the defrost operation and then the temperature in the refrigerator falls excessively which causes the stored foods to become frozen.

Another defrost control method is a method which evaluates the position of the doors. A typical example is disclosed in U.S. Pat. No. 4,297,852. Because this does not simultaneously evaluate the temperature, the defrost time and the position of the doors, this method also has the above problem.

SUMMARY OF THE INVENTION

It is an object to provide a defrost control method which evaluates the defrost time, the temperature in a refrigerator and the position of the doors and starts the defrost operation when all three conditions are simultaneously satisfied.

In order to achieve the object, the accumulated operation time of the compressor is recorded and the count time is then compared to the defrost start time. If the count time reaches that of the defrost start time, it is determined whether or not the temperature of the refrigerator is low enough to start the defrost operation. If the temperature is low enough to start the defrost operation, the position of the doors is detected. If the doors are closed, the defrost operation starts. Accordingly, when the three conditions are satisfied, the defrost operation starts.

DETAILED DESCRIPTION OF THE INVENTION

Figure 1:
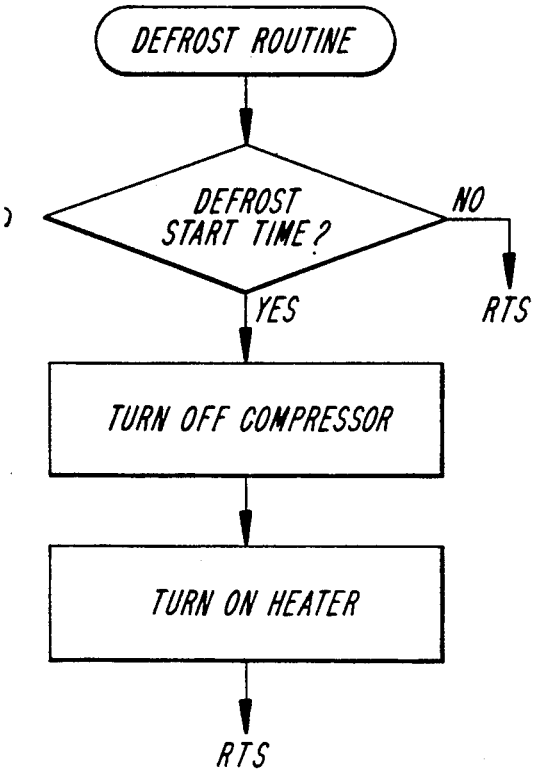
FIG. 1 (PRIOR ART)
FIG. 1 is a flow chart showing a prior defrost control method.
Figure 2:
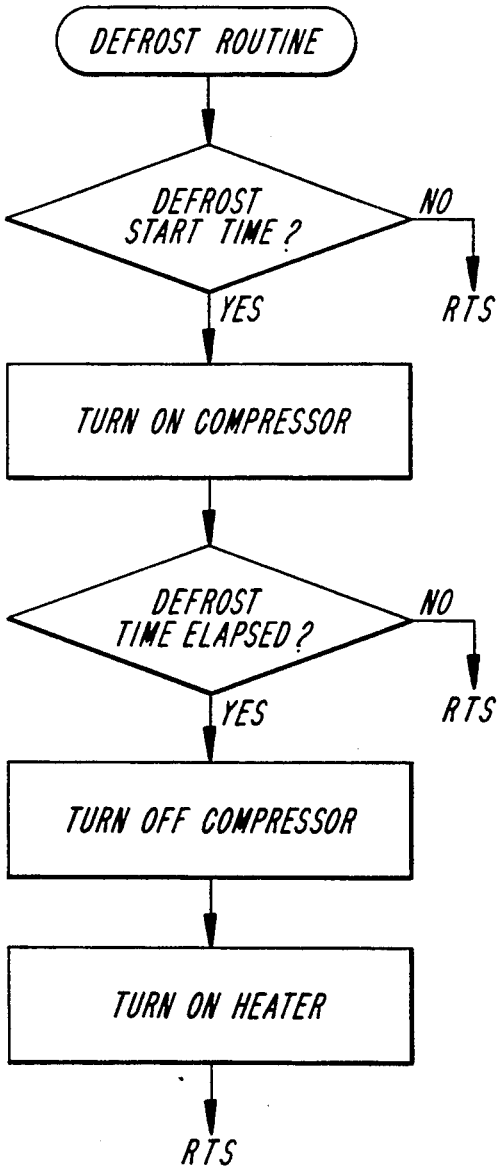
FIG. 2 (PRIOR ART)
FIG. 2 is a flow chart showing another prior defrost control method.
Figure 3:
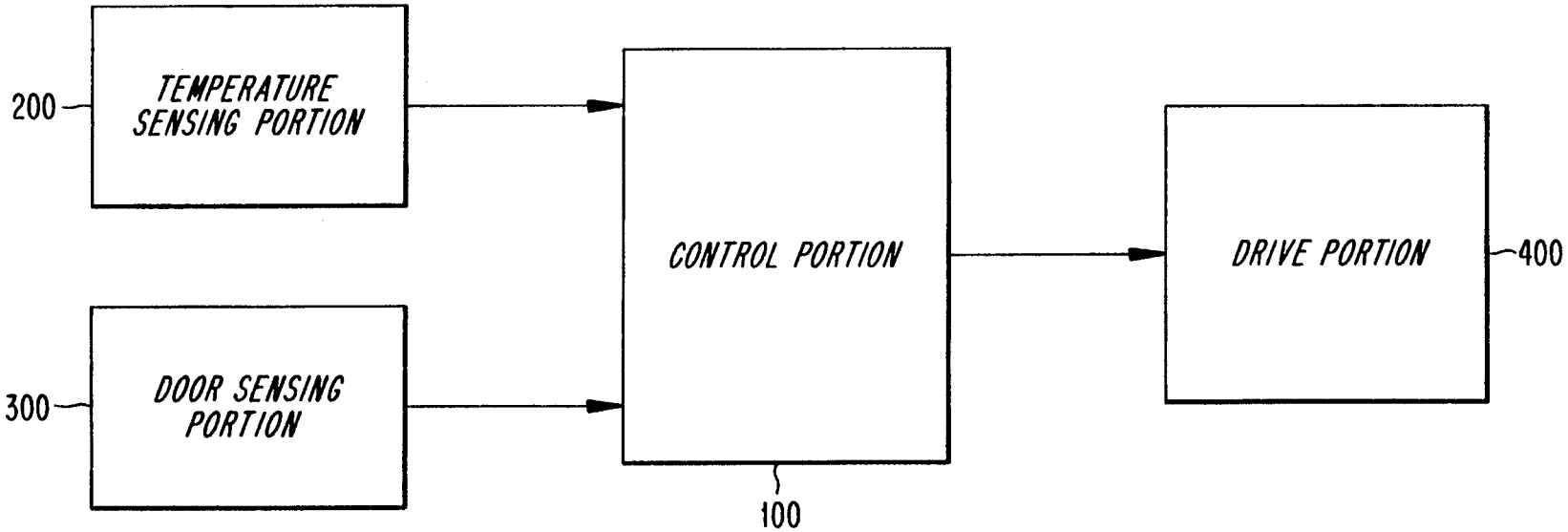
FIG. 3 is a schematic block diagram showing the circuit diagram of the refrigerator applied to the present invention.

In reference to the drawings, the detailed description of the preferred embodiment of the present invention is as follows:

FIG. 3 is a schematic block diagram showing the circuit diagram of the refrigerator applied to the present invention. It is comprised of control portion 100, temperature sensing portion 200 for sensing the temperature in the refrigerator, door sensing portion 300 for sensing the position of the doors, drive portion 400 for driving a heater and a compressor according to the control signal output from the control portion 100.

The control portion 100 receives temperature data output from the temperature sensing portion 200. When the temperature rises to the predetermined temperature, the refrigerator compressor is started in order to provide the freezing and refrigerating modes thereby causing the temperature of the refrigerator to fall. In order to control the temperature of the refrigerator it is then determined whether or not the doors of the refrigerator are open. Thus, according to the result, the control portion 100 determines whether or not the defrost operation should be started. Depending on the result determined above, the refrigerator may operate in the freezing and the refrigerating modes, wherein the compressor is turned on and the heater is turned off. On the other hand, when the refrigerator operates in the defrost mode, the compressor is turned off and the heater is turned on.

Figure 4A:
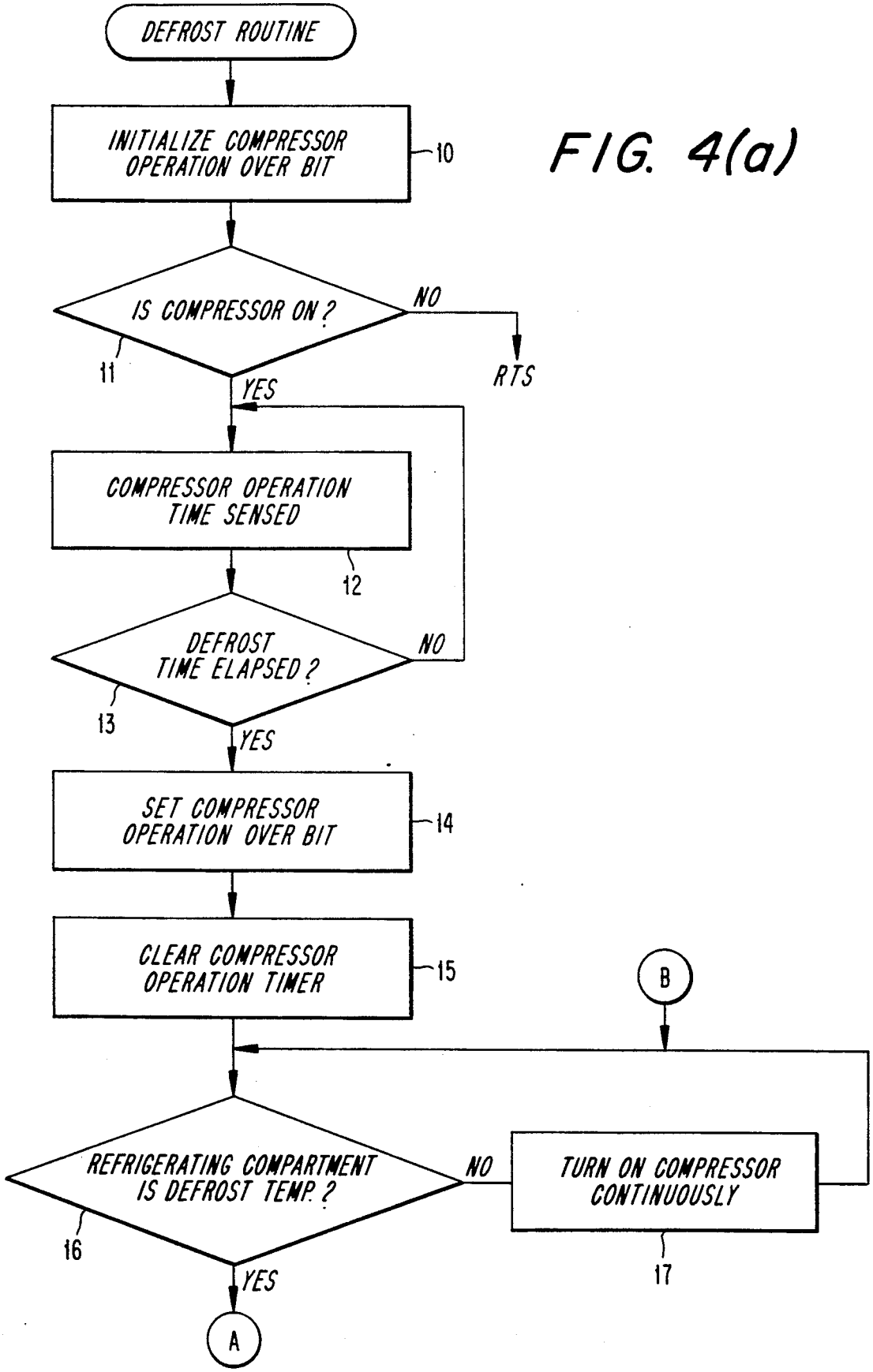
FIGS. 4(*a*) and 4(*b*) is a flow chart of the defrost control method applied to the present invention.
Figure 4B:
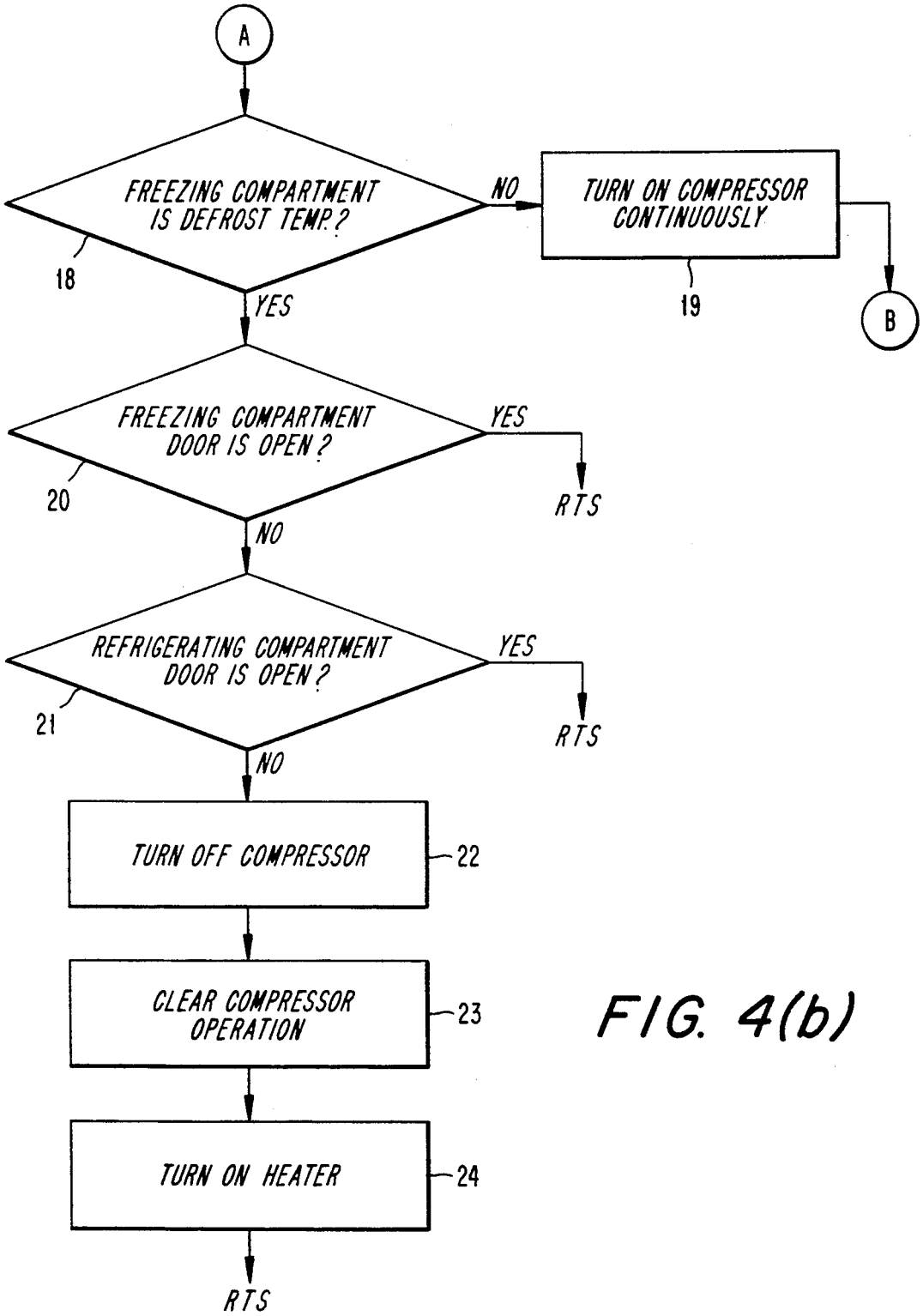

FIGS. 4(*a*) and 4(*b*) depict are a flow chart showing the defrost control method applied to the present invention. After the power is turned on the initializing process is performed, the operation of the refrigerator is begun, the defrost subroutine is executed as follows:

In step 10, a compressor operation over bit which indicates that the operation time of the compressor reached a predetermined time is clearer. In step 11, it is determined whether or not the compressor is turned on. When the answer is "no", the next routine is executed. When the answer is "yes", then in step 12, a compressor operation timer records the accumulated operation time. Successively, in step 13, the accumulated compressor operation time is compared with the defrost start time. When the accumulated compressed operation time reaches the defrost start time, the compressor operation over bit is set in step 14. When the accumulated operation time has not reached the defrost start time, the compressor is operated continuously and the accumulated operation time recored by the compressor operation timer increases. In step 15, the compressor operation timer is cleared in order to be ready to count the next defrost time. In step 16, the temperature data is supplied by the temperature sensing portion 200 and it is determined whether or not the temperature in the refrigerating compartment has descended to a defrost start temperature. If the temperature has not descended to the defrost start temperature, even if the defrost start time has elapsed, then in step 17, the compressor is forcibly driven so that the temperature of the refrigerating compartment will be reduced and step 16 is thereafter executed again. As a result of step 16, if the temperature of the refrigerating compartment has descended to the defrost start temperature, in step 18, it is determined whether or not the temperature of the freezing compartment has descended to a defrost start temperature.

Thus, when the answer is "no" in step 18, the compressor is turned on in step 19 so that the temperature in the freezing compartment is reduced. When the answer is "yes" in step 18, the position of the doors is sensed by the door sensing portion 300 in step 20. Even if the conditions according to the operation time of the compressor and the temperature of the refrigerator are satisfied, if the doors of the refrigerator are in an open position, it would be unsuitable for the defrost operation to be performed.

Accordingly, in steps 20 and 21, it is determined whether the doors of the freezing compartment and refrigerating compartment are open. When any one of the doors is open, another routine is executed. When none of the doors is open, then in step 22, the compressor is turned off. In order to store in bit that the next compressor operation time reaches to the next defrost start time, the compressor operation over bit is cleared in step 23. In step 24, the heater is turned on and the defrost operation starts.

Therefore, when the requirements for the defrost time, the temperatures of the freezing compartment and the refrigerating compartment and the position of the doors are simultaneously satisfied, the defrost operation starts.

As described above, the present invention for a refrigerating system prevents, in refrigerating system, putrefaction of stored foods and a rise in the temperature in a refrigerating system in which the defrost operation starts after considering only the elapse of the defrost start time.

What is claimed is:

1. A method for defrosting a refrigerator, comprising the steps of:

A) comparing a sensed temperature within said refrigerator with a predetermined temperature when a defrost start time is reached, B) causing a compressor to operate to reduce the temperature in said refrigerator if said sensed temperature is above said predetermined temperature, C) detecting the open/closed condition of doors of said refrigerator when said sensed temperature is at or below said predetermined temperature, and D) deactivating said compressor and activating a defrost heater if said doors are sensed to be closed.

2. A method according to claim 1 including prior to step A, the step of sensing whether said compressor is ON, and performing step A if said compressor is sensed to be ON.

3. A method according to claim 1, wherein the temperature sensed in step A is the temperature of a refrigeration compartment.

4. A method according to claim 1, wherein the temperature sensed in step A is the temperature of a freezer compartment.

5. A method according to claim 1, wherein the temperatures of a refrigerating compartment and a freezer compartment are sensed in step A.

* * * * *